US006147649A

United States Patent [19]

Ivrissimtzis et al.

[11] Patent Number: 6,147,649

[45] Date of Patent: Nov. 14, 2000

[54] DIRECTIVE ANTENNA FOR MOBILE TELEPHONES

[75] Inventors: Leonidas Ivrissimtzis; Rupert James Waldron, both of Berkshire, United Kingdom

[73] Assignee: NEC Corporation, Tokyo, Japan

[21] Appl. No.: 09/238,746

[22] Filed: Jan. 28, 1999

[30] Foreign Application Priority Data

Jan. 31, 1998 [GB] United Kingdom ..... 9802012

[51] Int. Cl.[7] ..... H01Q 1/24

[52] U.S. Cl. ..... 343/700 MS; 343/702

[58] Field of Search ..... 343/700 MS, 702, 343/846; H01Q 1/24, 1/38

[56] References Cited

U.S. PATENT DOCUMENTS 5,148,181 9/1992 Yokoyama et al. ..... 343/700 MS

*Primary Examiner*—Michael C. Wimer

*Attorney, Agent, or Firm*—Sughrue, Mion, Zinn, Macpeak & Seas, PLLC

[57] ABSTRACT

The antenna comprises a single rectangular sheet of copper which has been bent firstly to produce a first patch antenna section 1 and secondly to produce a second patch antenna section 3, sections 1 and 3 being joined by and contiguous with section 2. Section 2 is an integral part of the copper sheet and maintains the two sections 1 and 3 in substantially parallel spaced relationship with each other. An air gap 4 exists between sections 1 and 3. Other low absorption insulators may be used in place of air gap 4 and may be selected from a range of such insulators well known in the art. The antenna is backed by a ground plane 6 and is fed by means of a coaxial connector 5 to the distal edge of the larger patch at 7 where excitation of the antenna is effected.

12 Claims, 3 Drawing Sheets

DIRECTIVE ANTENNA FOR MOBILE TELEPHONES

BACKGROUND OF THE INVENTION

1. Field of the Invention

This invention relates to antennas for use with radio transceivers and in particular for use with mobile telephones.

2. Description of the Related Art

The design of antennas for radio transmitter/receivers (transceivers) capable of operation in more than one frequency band is constrained by the market demand continually to reduce the overall size of radio transceivers. The term "dual mode" is generally used to describe a radio transceiver capable of operation in two separate frequency bands and that description will be used herein.

An antenna for a foldable or "flip" telephone will need to be especially compact while still being capable of providing satisfactory performance. Simplified illustrations of a foldable phone are given in the accompanying figures. Foldable phones as illustrated in the figures usually comprise two housings of approximately the same size.

When such a telephone is in the closed position, performance of the antenna must also be sufficient to enable the satisfactory reception of incoming signals. The two sections of the flip phone are usually connected by a hinge mechanism and the phone is normally used in the open position as shown in figure . Incoming calls however, as well as text and data messages must be received when the phone is in the closed position with the two sections of the phone pushed together.

The display screen and keypad would usually be located in the bottom section of the phone.

The performance of many prior art antennas is significantly reduced by the proximity of the user during operation of the phone. It has been observed, however, that for antennas constructed in accordance with the invention only a small degradation occurs (less than 1 dB).

SUMMARY OF THE INVENTION

It is an object of the invention to provide a compact dual mode duplex antenna which is simple to manufacture. A further object of the invention is to construct a dual mode duplex antenna which transmits, when in operation, only very low power levels of RF (radio frequency) towards the body of the user.

According to the invention there is provided for use with a mobile telephone, a patch antenna for transmission and reception of RF in two frequency bands said antenna comprising a single metal sheet formed to provide a larger patch and a smaller patch with part of the metal sheet intermediate and contiguous with larger and smaller patches, the larger and smaller patches being maintained in parallel spaced relationship with each other above a reflecting ground plane.

The single metal sheet may also be formed by the deposition of the metal on an insulating plate.

One example of the invention will now be described with reference to the accompanying figures.

DETAILED DESCRIPTION OF THE PRESENT INVENTION

Figure 2:
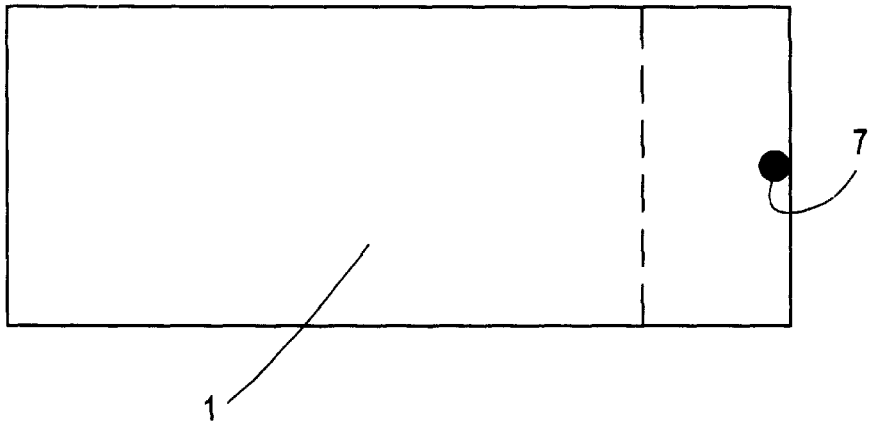
FIG. 2 is a plan view of the antenna in the direction A—A of FIG. 1.
Figure 3:
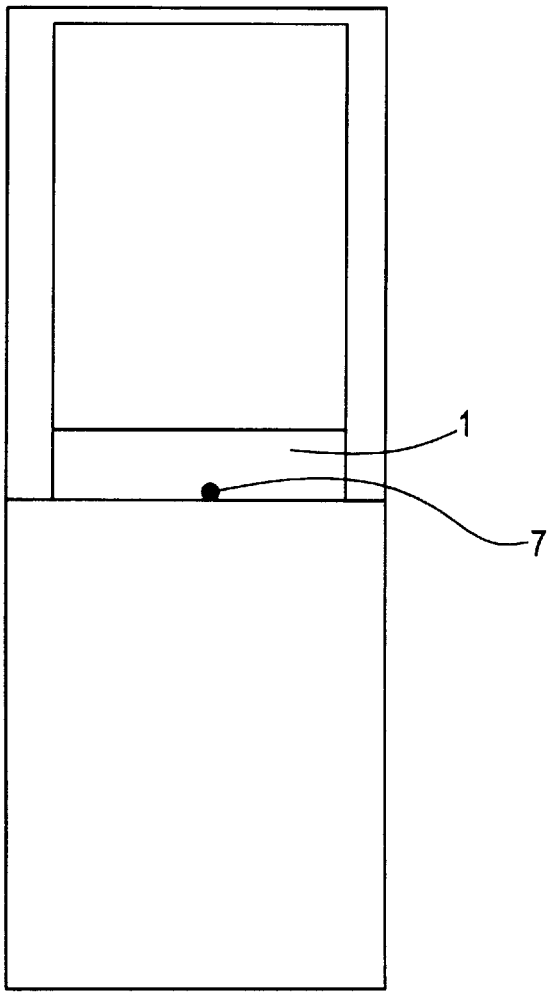
FIG. 3 is a simplified view of a foldable phone in the open position.

In this example, a foldable telephone as illustrated in FIGS. 2 and 3 is operable in two network bands, the two network bands being GSM 900 operating in the band 890 to 960 MHz and DCS 1800 operating in the band 1710 to 1880 MHz.

Figure 1:
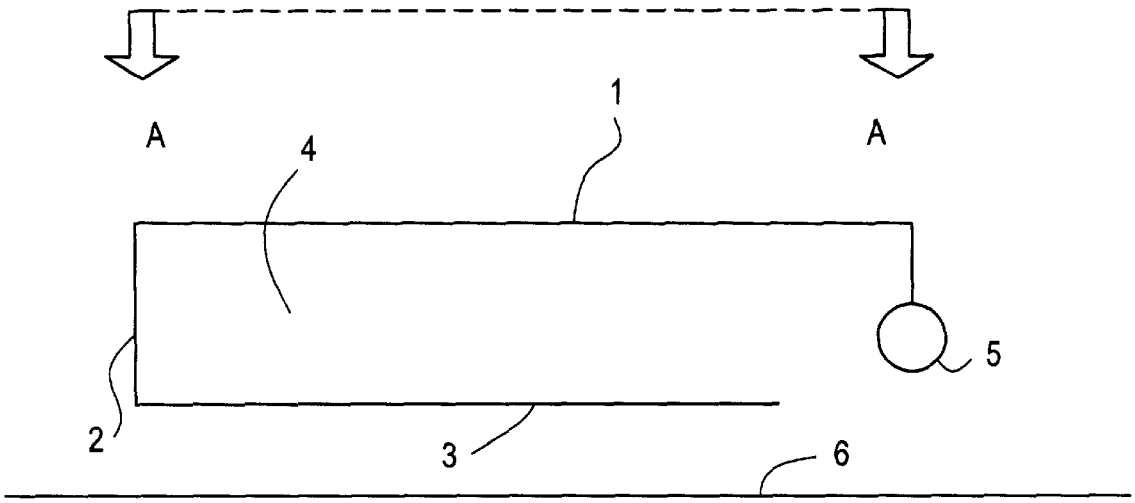
FIG. 1 is a simplified cross sectional view of an antenna constructed in accordance with the invention.

With reference to the figures, in which the parts illustrated are given the same numbers throughout, a simplified cross sectional view of the antenna is shown in FIGS. 1 and 2. The antenna comprises a single rectangular sheet of copper which has been bent firstly to produce a first patch antenna section 1 and secondly to produce a second patch antenna section 3, sections 1 and 3 being joined by and contiguous with section 2. Section 2 is an integral part of the copper sheet and maintains the two sections 1 and 3 in substantially parallel spaced relationship with each other. An air gap 4 exists between sections 1 and 3. Other low absorption insulators may be used in place of air gap 4 and may be selected from a range of such insulators well known in the art. The antenna is backed by a ground plane 6 and is fed by means of a coaxial connector 5 to the distal edge of the larger patch at 7 where excitation of the antenna is effected.

The reflecting grounded plane 6 may be provided, as in this example, as part of the housing of the phone. The larger antenna section 1 operates in duplex mode in the frequency band 890 to 960 MHz (GSM 900) and the smaller antenna section 3 operates in the duplex mode in frequency band 1710 to 1880 MHz (DCS 1800).

Figure 4:
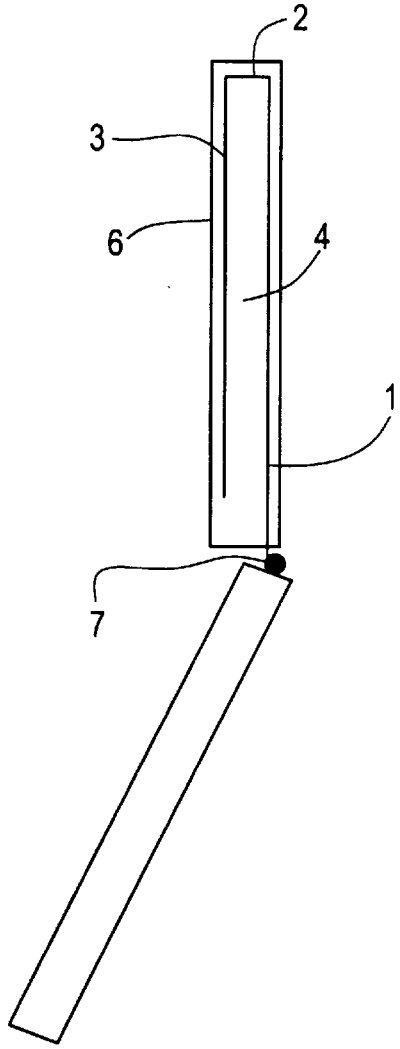
FIG. 4 is a simplified side view of a foldable phone in the open position.

Use of the antenna with a foldable phone is illustrated in FIGS. 3 and 4. The antenna is contained within the top section of the phone and the ground plane is part of the case of the phone. The resonance frequencies of the antenna are determined by the lengths of the larger and smaller patches. The bandwidth of operation is affected by the distance of the antenna from the reflecting ground plate 6, the type of dielectric material 4, the width of the larger and smaller patches 1, 3 and the width of the reflecting plate 6.

Figure 5:
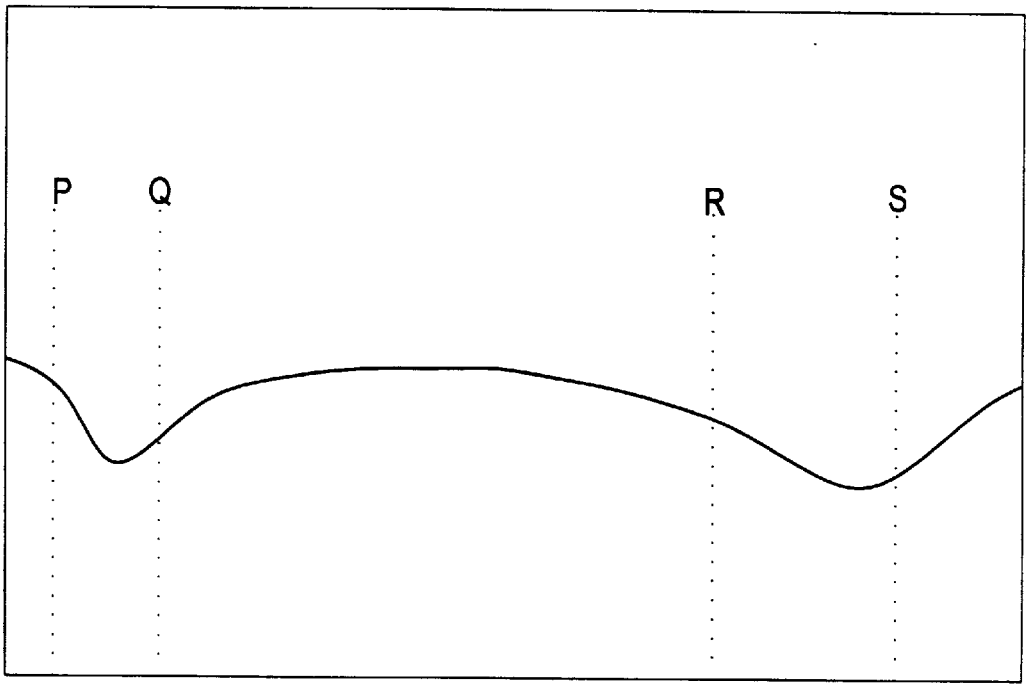
FIG. 5 is a plot of antenna gain versus frequency for the folded patch antenna.

The plot of antenna gain versus frequency at FIG. 5 shows the results achieved by the antenna in the two frequency bands DCS 1800 and GSM 900. With reference to 0 dB the point P on the plot is 890 MHz and −11.483 dB, the point Q is 960 MHz and −11.156 dB, the point R is 1.72 GHz and −8.989 dB and the point S is 1.88 GHz and −12.573 dB.

What is claimed is:

1. For use with a foldable mobile telephone, a patch antenna fully enclosed within a foldable phone casing for transmission and reception of RF in two frequency bands, wherein said casing is comprised of a first portion and a second portion foldably connected by a hinge, said antenna comprising a single metal sheet formed to provide a larger patch and a smaller patch with part of the metal sheet intermediate and contiguous with the larger and the smaller patches, the larger and the smaller patches being maintained in parallel spaced relationship with each other above a reflecting ground plane, and wherein said larger patch is used to accommodate low frequencies and said smaller patch is used to accommodate high frequencies.

2. An antenna as in claim 1 where the parallel spaced relationship between larger and smaller patches is maintained by means of said part of the metal sheet intermediate and contiguous with larger and smaller patches.

3. An antenna as in claim 1 where electrically insulating material occupies the space between larger and smaller patches.

4. An antenna as in claim 2 where electrically insulating material occupies the space between larger and smaller patches.

5. An antenna as in claim 3 where the electrically insulating material between larger and smaller patches is an air gap.

6. An antenna as in claim 4 where the electrically insulating material between larger and smaller patches is an air gap.

7. An antenna as in claim 1 where the metal sheet is formed by plating on an insulated board.

8. An antenna as in claim 1 where both larger and smaller patches have the same width.

9. An antenna as in claim 1 where the reflecting grounded plane is part of the housing of the phone.

10. An antenna as in claim 1 where the antenna is fed at the distal edge of the larger patch.

11. An antenna as in claim 1 for use in the two frequency bands 890 to 960 MHz and 1710 to 1880 MHz.

12. An antenna as in claim 1 where said antenna substantially covers the interior periphery of said casing.

* * * * *

UNITED STATES PATENT AND TRADEMARK OFFICE

CERTIFICATE OF CORRECTION

PATENT NO. : 6,147,649
DATED : November 14, 2000
INVENTOR(S) : Leonidas Ivrissimtzis, Rupert James Waldron It is certified that error appears in the above-identified patent and that said Letters Patent is hereby corrected as shown below:

Title page, Item [30],
Foreign Application Priority Data insert -- .6 -- after "9802012"

Signed and Sealed this

Sixteenth Day of October, 2001

*Attest:*

Nicholas P. Godici

NICHOLAS P. GODICI
*Acting Director of the United States Patent and Trademark Office*

*Attesting Officer*